US005309180A

United States Patent [19]

Uchida

[11] Patent Number: 5,309,180

[45] Date of Patent: May 3, 1994

[54] INK JET RECORDING APPARATUS AND RECOVERING MECHANISM THEREOF

[75] Inventor: Haruo Uchida, Yokohama, Japan

[73] Assignee: Canon Kabushiki Kaisha, Tokyo, Japan

[21] Appl. No.: 126,756

[22] Filed: Sep. 27, 1993

Related U.S. Application Data

[63] Continuation of Ser. No. 835,382, Feb. 14, 1992, abandoned.

[30] Foreign Application Priority Data

Feb. 15, 1991 [JP] Japan ..... 3-022092

[51] Int. Cl.[5] ..... B41J 2/18

[52] U.S. Cl. ..... 346/140 R

[58] Field of Search ..... 346/140 R, 75; 400/126; 417/474, 476

[56] References Cited

U.S. PATENT DOCUMENTS

| | | | |
|---|---|---|---|
| 3,807,131 | 4/1974 | Samson et al. | 417/476 |
| 4,313,124 | 1/1982 | Hara | 346/140 R |
| 4,345,262 | 8/1982 | Shirato et al. | 346/140 R |
| 4,359,744 | 11/1982 | Salmre | 346/1.1 |
| 4,376,283 | 3/1983 | Bower | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,853,717 | 8/1989 | Harmon et al. | 346/140 R |
| 4,925,376 | 5/1990 | Kahler | 417/476 |

FOREIGN PATENT DOCUMENTS

| | | |
|---|---|---|
| 0398347 | 11/1990 | European Pat. Off. . |
| 0424859 | 5/1991 | European Pat. Off. . |
| 2914986 | 10/1980 | Fed. Rep. of Germany . |
| 3333626 | 4/1985 | Fed. Rep. of Germany . |
| 0056847 | 5/1979 | Japan . |
| 0123670 | 7/1984 | Japan . |
| 0138461 | 8/1984 | Japan . |
| 0071260 | 4/1985 | Japan . |
| 03073352 | 3/1991 | Japan . |
| 03073354 | 3/1991 | Japan . |

*Primary Examiner*—Benjamin R. Fuller
*Assistant Examiner*—N. Le
*Attorney, Agent, or Firm*—Fitzpatrick, Cella, Harper & Scinto

[57] ABSTRACT

An ejection recovering unit includes tube pumps which generate pressure for performing ink enforced discharge of ink jet heads by sequentially deforming flexible tubes under pressure. Pressing rollers are spring biased toward a direction of preliminary pressurizing a spring for sequentially pressure deformation of tubes. This suppresses an increase in drive torque due to dispersion of accuracy of tubes, pressing rollers and mounting parts thereof. A guide is provided to place the corresponding roller in a state corresponding to a pressurizing state before the guide presses the corresponding tube. This prevents any change in torque due to sudden production of the pressurizing state.

11 Claims, 9 Drawing Sheets

INK JET RECORDING APPARATUS AND RECOVERING MECHANISM THEREOF

This application is a continuation of application Ser. No. 07/835,382 filed Feb. 14, 1992, now abandoned.

BACKGROUND OF THE INVENTION

1. Field of the Invention

The present invention relates to an ink jet recording apparatus and a recovering mechanism for an ink jet head, and particularly relates to a recovering unit for maintaining the ink jet head of an ink jet recording apparatus in a normal ink ejection state or recovering the ink jet head to the normal ejection state.

2. Description of the Related Art

Among the conventional ink jet recording apparatus, there is one which has a recovering pump arranged for the purposes of maintaining an ink jet head in a normal ink emission state or recovering the ink jet heads to the normal state when clogging takes place in an orifice or orifices. Ink is sucked out of the orifice or orifices, using vacuum produced by the recovering pump. Examples of such technique include the use of a tube pump as the recovering pump (for instance, see Japanese Laid-Open Patent Application Nos. 73352/1991 and 73354/1991. The tube pump produces vacuum by changing a volume in each flexible tube.

FIGS. 1A and 1B diagrammatically illustrate the tube pump. An opening of a cap 30 is brought into contact with a ink jet head 1 to perform capping of a face 1A on which orifices are formed. The cap 30 is provided in the rear side thereof with another opening, which is connected to a tube 3 as a member of the tube pump. A pressurizing roller 5 is provided to each tube 3 for pressurizing, and a shaft 5A thereof is rotatably supported to a guide roller 4. The guide roller 4 is rotatably mounted at a shaft 4A thereof to a pump base 6. The pump base 6 has an arcuate groove 6A formed concentrically with the shaft 4A of the guide roller 4.

When in such a construction, the guide roller 4 is rotated in the direction of the arrow a by a drive mechanism (not shown), the pressurizing roller 5 on the guide roller 4 is brought into contact with the tube 3 in the portion X in FIG. 1A to press the tube 3, so that the tube is resiliently deformed to bring the cross-sectional area of the interior thereof at the portion X to substantially naught. The guide roller 4 is further rotated in the direction of the arrows a from this state. This makes the pressurizing roller 5 to rotate in the direction of the arrow b in a following manner, collapsing the tube 3. The pressurizing roller 5 is temporarily stopped at a portion Y of the tube 3 as shown in FIG. 1B. During this operation, negative pressure is produced in the face 1A of the head 1 due to change in volume of the interior of the tube while the roller 5 presses the tube 3 between the portions X and Y thereof. The negative pressure enables suction of ink from the orifices. A waste ink container 7 is arranged downstream of the tube 3 for containing ink sucked from the orifices.

Such a tube pump is advantageous in that it is simple in construction and it is capable of constitute a small and low cost suction recovering unit. The inventors however have found that the tube pump can raise problems below.

The amount of overlapping of the pressurizing roller 5 with the corresponding tube 3 (the amount of penetration of the pressurizing roller 5 upon the tube 3) depends on the distance from the axis of the guide roller 4 to the axis of the pressurizing roller shaft 5A, the outer diameter of the pressurizing roller 5, the shape of the arcuate groove 6A concentric with the guide roller 4, the thickness of the tube 3, plays to these members, etc. The minimum amount of penetration which bring the cross-sectional area of the interior of the tube 3 to substantially naught must be determined in view of a tolerance of each of the members. In the case where the amount of penetration of the pressurizing roller 5 increases due to the tolerance, the torque to drive the pump, that is, the torque to rotate the guide roller 4 in the direction of arrow a, must be also increased. This necessitates the torque of a pump drive motor to be enlarged, and therefore it is like to raise a cost of the motor. In the case of excessively large amount of penetration, wear of the tubes is accelerated, durability of the tubes is deteriorated, and hence the tubes are liable to be broken.

For the purpose of obtaining a small and low cost recording apparatus, in the case where a motor is commonly used as the pump drive motor and a recording medium feeding motor (vertical or subscanning motor) or a carriage drive motor (horizontal or main scanning motor), the following problems are likely to be produced: the motor can be stepped out due to change in torque at an instant when tubes 3 are pressed by the pressurizing roller 5 or are released from the pressurizing rollers 5; accuracy of feed of the recording medium is adversely affected; the picture of printing is deteriorated in quality due to nonuniform scanning.

In the case where a plurality of heads are used, a plurality of tubes 3 and pressurizing rollers 5 are provided. Thus, an increase in the amount of penetration according to the tolerance of each component become larger as the increase of the number of the heads. This makes influences of the problems previously described larger.

SUMMARY OF THE INVENTION

An object of the invention is to prevent the increase in drive torque of a tube pump due to variations of component tolerances, thereby reducing the size and cost of a pump drive motor.

Another object of the invention is to suppress the increase in torque in the case where a pump is assembled using tubes and pressurizing rollers with a plurality of recording heads, as compared to the conventional construction.

A further object of the invention is to minimize a change in torque produced at the instant when a tube is pressed by or released from a pressurizing member, thereby eliminating step-out of a pump drive motor and an irregularity of horizontal or vertical scanning in the case where the motor is commonly used as a horizontal or a vertical scanning motor.

Still further object of the invention is to provide small sized and low cost recovering unit and ink jet recording apparatus.

In the first aspect of the present invention, a recovering mechanism for an ink jet recording apparatus, for maintaining or recovering an ejection state of an ink jet head by discharging ink through or orifice or orifices of the ink jet head in an enforced manner, comprises:

a flexible tube;

a pressurizing member for producing pressure in a pressurizing state to perform the enforced discharging of ink by resiliently deforming the tube continuously along an axial direction of the tube;

biasing means for resiliently biasing the pressurizing member in a direction to press the tube;

guide means, arranged adjacent to a region to press the tube by the pressurizing member, for placing the pressurizing member in a state, substantially corresponding to the pressurizing state.

Here, a recovering mechanism for ink jet recording apparatus may further comprise a base of the unit and a restraining member for restraining the tube of the base, and wherein the guide means and the restraining member are integrally formed.

The guide means may be disposed before and/or behind the region to press the tube.

The guide means may be disposed along a path of the pressurizing member except the region to press the tube, and may place the pressurizing member in the state, substantially corresponding to the pressurizing state, all the way along the path.

The pressurizing member may have a roller, and the biasing means may have a spring.

The pressurizing member and the biasing means may be integrally formed as one member which has a roller having a portion made of an elastic material, the portion performing pressurizing of the tube.

In the second aspect of the present invention, an ink jet recording apparatus comprises:

at least one ink jet head;

at least one recovering mechanism as claimed in claim 1; and transporting means for transporting a recording medium to a recording position in which recording is carried out by the at least one ink jet head.

Here, an ink jet recording apparatus may further comprise drive means for driving the pressurizing member to deform the tube continuously in the pressurizing state, the drive means including a drive source, the drive source being also used as a drive source for the transporting means.

An ink jet recording apparatus may further comprise scanning means for performing horizontal scanning of the ink jet head over the recording medium.

An ink jet recording apparatus may further comprise drive means for driving the pressurizing member to deform the tube continuously in the pressurizing state, the drive means including a drive source, the drive source being also used as a drive source for the scanning means.

The at least one ink jet head may have an element or elements for generating thermal energy to produce film boiling in ink, the thermal energy being to be used for ink ejection.

In the third aspect of the present invention, a liquid transporting apparatus comprise:

a hollow resilient member adapted to flow liquid therethrough;

a pressurizing member;

a member to be pressed;

pressure producing means for placing the pressurizing member in a pressurizing state in a first region, in the pressurizing state the pressurizing member being urged against the member to be pressed with the hollow resilient member sandwiched therebetween, and for moving the pressurizing member in the pressurizing state for producing pressure to cause liquid to flow; and guide means for previously guiding the pressurizing means in a state, corresponding to the pressurizing state, in a second region before the first region in which the pressurizing member and the member to be pressed urged the hollow resilient member in cooperation with each other.

The above and other objects, effects, features and advantages of the present invention will become more apparent from the following description of embodiments thereof taken in conjunction with the accompanying drawings.

DETAILED DESCRIPTION OF PREFERRED EMBODIMENTS

First Embodiment

Figure 2:
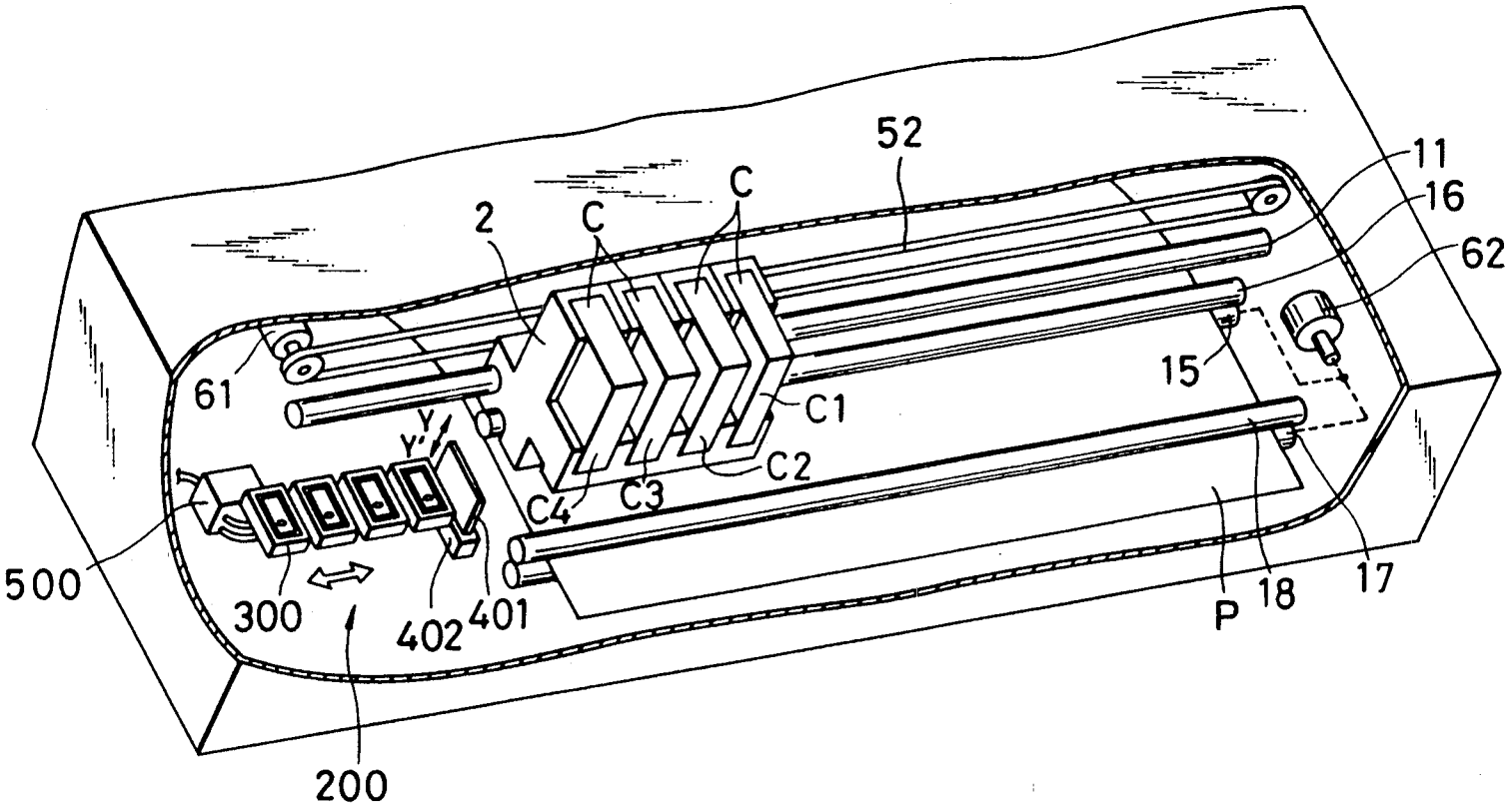
FIG. 2 is a perspective view illustrating an ink jet recording apparatus to which the present invention is applied.
Figure 3:
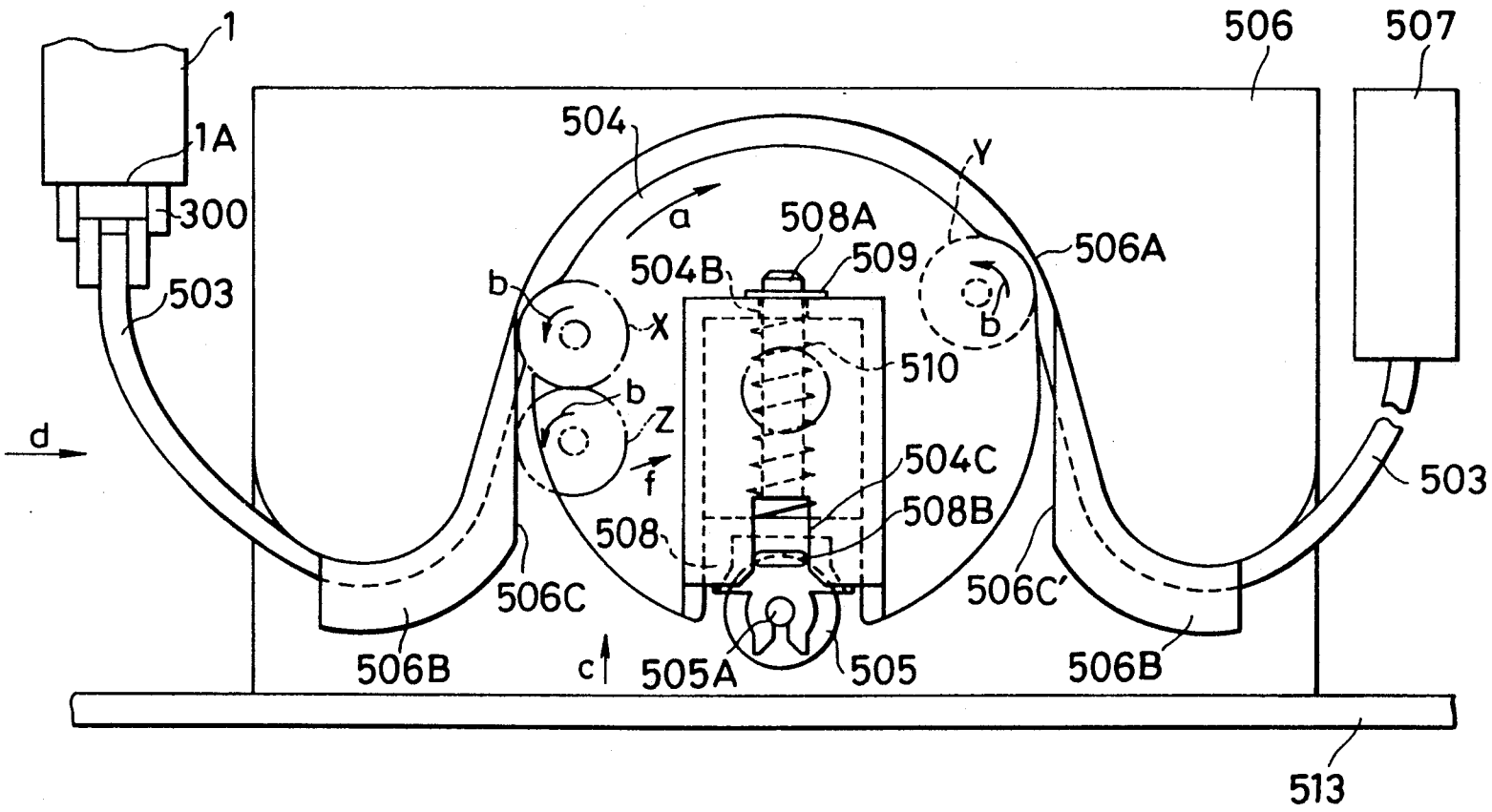
FIG. 3 is a front view in section of a embodiment of a recovering unit according to the present invention.

Referring to FIGS. 2 to 6, an ink jet recording apparatus according to the present invention will be described. In FIG. 2, the reference character C designates an ink jet cartridge. Each of the ink jet cartridges C is integrally provided with an ink tank and a recording head. The ink tank is mounted to an upper portion of the cartridge C whereas the recording head is provided at a lower portion thereof. Each ink jet cartridge C is moreover provided with a connector for receiving signals to drive the recording head. The recording head of each ink jet cartridge C has orifices formed at the bottom thereof. Elements for generating energy used for ejecting ink are arranged in respective liquid passages of the recording head, the liquid passages being communicated to the corresponding orifices. The liquid passages communicate to a common liquid chamber, where ink which is supplied from the ink tank is contained. As the energy generating elements, electro-thermal converting elements are preferably used since they enable the orifices and the liquid passages to be largely integrated.

The reference numeral 2 designates a carriage which mounts four cartridges C1, C2, C3 and C4 on it in predetermined respective positions. The cartridges C1, C2, C3 and C4 correspond to different inks, yellow, magenta, cyan and black inks, for example. The carriage 2 is provided with a connector holder (not shown) for electrical connection with the recording head to transmit signals to drive the recording head. The carriage 2 is further provided on its bottom portion with ink absorbers, the absorbers being located on the opposite sides of each recording head.

The reference numeral 11 designates a scanning rail which extends in the main scanning direction of the carriage 2 to slidably support the carriage 2. The reference numeral 52 designates an endless drive belt for transmitting a driving force produced by a main scanning motor 61 to reciprocally move the carriage 2. There are provided two pairs of feed rollers 15, 16; 17, 18 which are arranged before and behind a recording position of the recording heads to hold and feed a recording medium P such as paper sheet. These rollers are connected to a sub scanning motor 62 via a suitable driving mechanism. The recording medium P is tightened against a platen (not shown) for flattening a recording surface of the recording medium P. The recording heads of the ink jet cartridges C are arranged to project downwardly through the carriage 2 and to intervene between the feed rollers 16 and 18. A face on which the orifices are formed of each recording head is disposed to oppositely face to the recording medium which is pressed over the guide surface of the platen.

In the ink jet recording apparatus of this embodiment, a recovering unit 200 as recovering means is arranged on the home position side in the left side of FIG. 2. In the recovering unit 200, cap units 300 are provided to correspond to the ink jet cartridges C which have recording heads. The cap units 300 are slidable in the lateral directions shown by the arrow in FIG. 2 as the carriage 2 moves, and are also vertically slidable as they laterally slide. When the carriage 2 is in the home position, each of the cap units 300 makes a contact with the corresponding recording head for capping. The cap units 300 prevent ink in the orifices of corresponding recording heads from increasing in viscosity due to evaporation, so that poor ejection or ejection error of ink due to adhesion is positively prevented.

In the recovering unit 200, the reference numeral 500 indicates a pump unit which communicates to the cap units 300. In the case where ejection error takes place in one or more of the recording heads, the pump unit 500 is used to produce negative pressure to perform a suction recovery operation in which cap units 300 and the corresponding recording heads are brought into contact to each other. In the recovering unit 200, the reference numeral 401 designates a blade, made of a resilient material such as a rubber, as a wiping member, and 402 a blade holder for holding a blade 401. In this embodiment, the blade 401 is selectively set by a blade elevating mechanism (not shown) to two positions: a wiping position in which the blade 401 is projected or raised to wipe ink stained on the face on which the orifices are disposed of each recording head; and a lowered or waiting position in which the blade 401 is retracted or lowered not to contact the face. The blade elevating mechanism is driven by the movement of the carriage 2.

In this embodiment, wiping is carried out by the blade 401 only when the carriage 2 is removed from the left, where the recovering unit 200 is located, to the right in FIG. 2. This is because as the blade 401 is located between the cap units 300 and the feeding units of the recording medium P, there is a possibility that the recording medium is unintentionally spoiled by ink which has been scattered around the feed unit of the recording medium P by resilient wiping of the blade 401 when the carriage 2 is moved from the right to the left in FIG. 2. In the case where there is no such a possibility, wiping in the opposite directions may be carried out.

For performing and releasing of capping by sliding or elevating the cap units 300, wiping by vertical movement of the blade 401 and controlling of the direction of wiping, mechanisms disclosed in Japanese Patent Application Laying-open No. 73352/1991 or No. 73354/1991 may be used. The Japanese patent applications were assigned to the assignee of the subject application, and the disclosures thereof are incorporated herein by reference. Alternatively, driving means, having a motor or a solenoid, for elevating the cap unit 300 and the blade 401 and means for controlling the driving means may be used.

FIGS. 3 to 6 illustrate one embodiment of the recovering unit 200 according to the present invention. In the case where clogging takes place in the orifice of one of the ink jet heads 1, a suction recovering operation is carried out in the home position. The construction of this embodiment will be described together with the suction recovering operation.

In the home position, capping of the face 1A is conducted by bringing an opening of corresponding one of the cap units 300 into contact with the ink jet head 1. The cap 300 is provided in the rear side thereof with another opening, which is connected to a tube 503 as a member of a tube pump.

Figure 5:
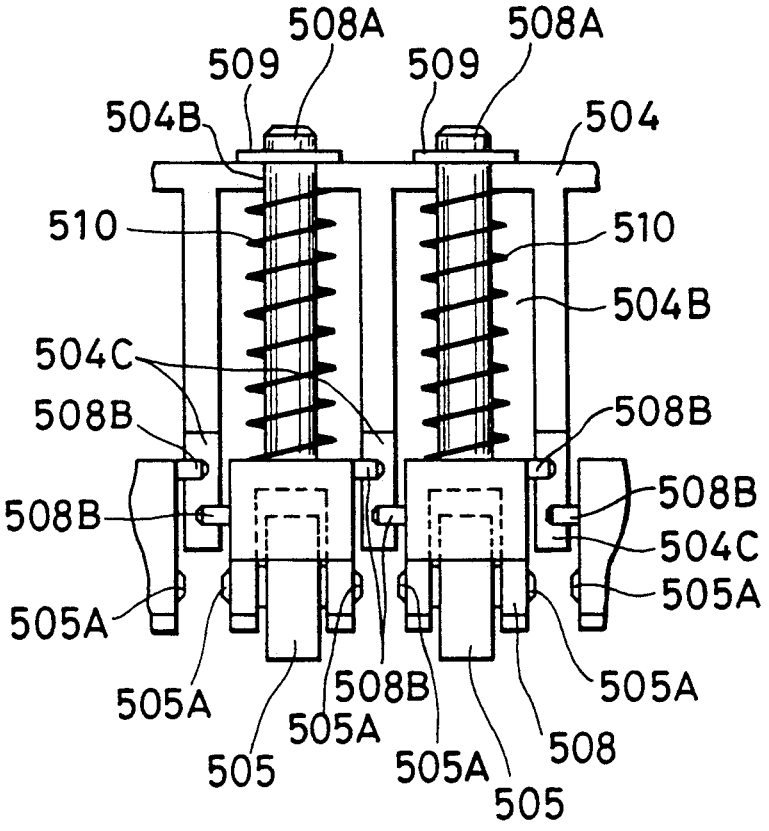
FIG. 5 is a fragmentary vertical cross-sectional view of the recovering unit of FIG. 3.

The tube 503 has a resiliency at at least a portion to be pressed by a pressurizing roller 505. The pressurizing roller 505 is rotatably mounted at a rotary shaft 505A thereof to a roller bearing 508. The roller bearing 508 is supported on a cylindrical shaft 508A, which is received in a hole 504B formed in a guide roller 504 with a compression spring 510 mounted around it. The roller bearing 508 is secured to the guide roller 504 by an E-shaped retaining ring 509. The pressurizing roller 505 is spring biased by the compression spring 510 radially outwardly of the guide roller 504 or in a direction to press the tube 503 when the pressurizing roller 505 is placed to contact the tube 503. The positioning of the roller bearing 508 is achieved by guiding a positioning pin 508B mounted on the roller bearing 508 along a guide slot 504C provided in the guide roller 504. Also, the positioning of the roller bearing 508 is carried out by guiding the cylindrical shaft 508A along the guide hole 504B in the guide roller 504. To reduce the volume of the pump, positioning pins 508B and 508B of adjacent roller bearings 508 and 508 are, as shown in FIG. 5, arranged in an overlapping manner in the same guide slot by changing the positioning pins 508B and 508B in height.

The shaft 504A of the guide roller 504 is rotatably attached to the pump base 506 through bearings 511 and 511. To prevent the bearings 511 and 511 from slipping out, E-shaped retaining rings 512 and 512 are arranged. The pump base 506 is provided with arcuate grooves 506A which are concentric with the guide roller 504. The pump base 506 is mounted to the base 513 of the recording apparatus with the lower openings of the grooves 506A being faced to the base 513. This enables the pump base 506 to serve as a closure. The pump base 506 covers the pump operating portion, and thereby malfunction of the pump due to careless touching of the pump operating portion and entering of foreign materials into the pump operation portion are prevented. Each of the tubes 503 is placed into tube securing grooves 506B and 506B for securing.

With such a construction, a roller 514 is driven by a drive source (not shown), and a drive gear 515 mounted on the roller 514 transmits the torque to a gear 504D provided to the guide roller 504. The roller 514 may e one of the paper feed rollers (rollers 15 to 18 of FIG. 1), for example. A retaining member 516 is disposed to prevent the drive gear 515 from slipping out.

When the drive gear 515 rotates in a forward rotational direction, that is, e direction (FIG. 6) corresponding to the paper feed direction during recording, of the roller 514 which is one of the paper feed rollers (for example, roller 15), the guide roller 504 is rotated to turn in the direction of the arrow a. This causes the pressurizing rollers 505 to be brought into contact with respective roller guide portions 506C, which are integrally formed with tube securing grooves 506B disposed on the pump base 506, at position shown by the dots-and-dash line in FIG. 3. In this event, the pressurizing rollers 505 are guided by the roller guide portions 506C and thereby gradually move in the direction of the arrow f or toward the axis of the roller 504 while rotating in the direction of the arrow b in a following manner. Thus, each of the pressurizing roller 505 is raised to a position to press the tube 503. The guide roller 504 is further rotated in the direction of the arrow a, causing each of the pressurizing rollers 505 to be brought into contact with the corresponding tube 503 at the position X shown by the dot-and-dash line, so that the interior of the tube 503 is reduced in cross-sectional area to naught. Before movement of each of the pressurizing rollers 505 from the Z position to the X position, the pressurizing roller 505 is moved to a position, corresponding to a position to press the tube 503, in the f direction, and therefore a sudden raise of force to be applied to the pressurizing roller 505 is removed when the pressurizing roller 505 moves to the position X. Each pressurizing roller 505 gradually pressed the corresponding tube 504 while it moves along the roller guide portion 504C, and change in torque applied to the roller 514 therefore becomes very small when each pressurizing roller 505 comes into contact with the tube 503.

Figure 4:
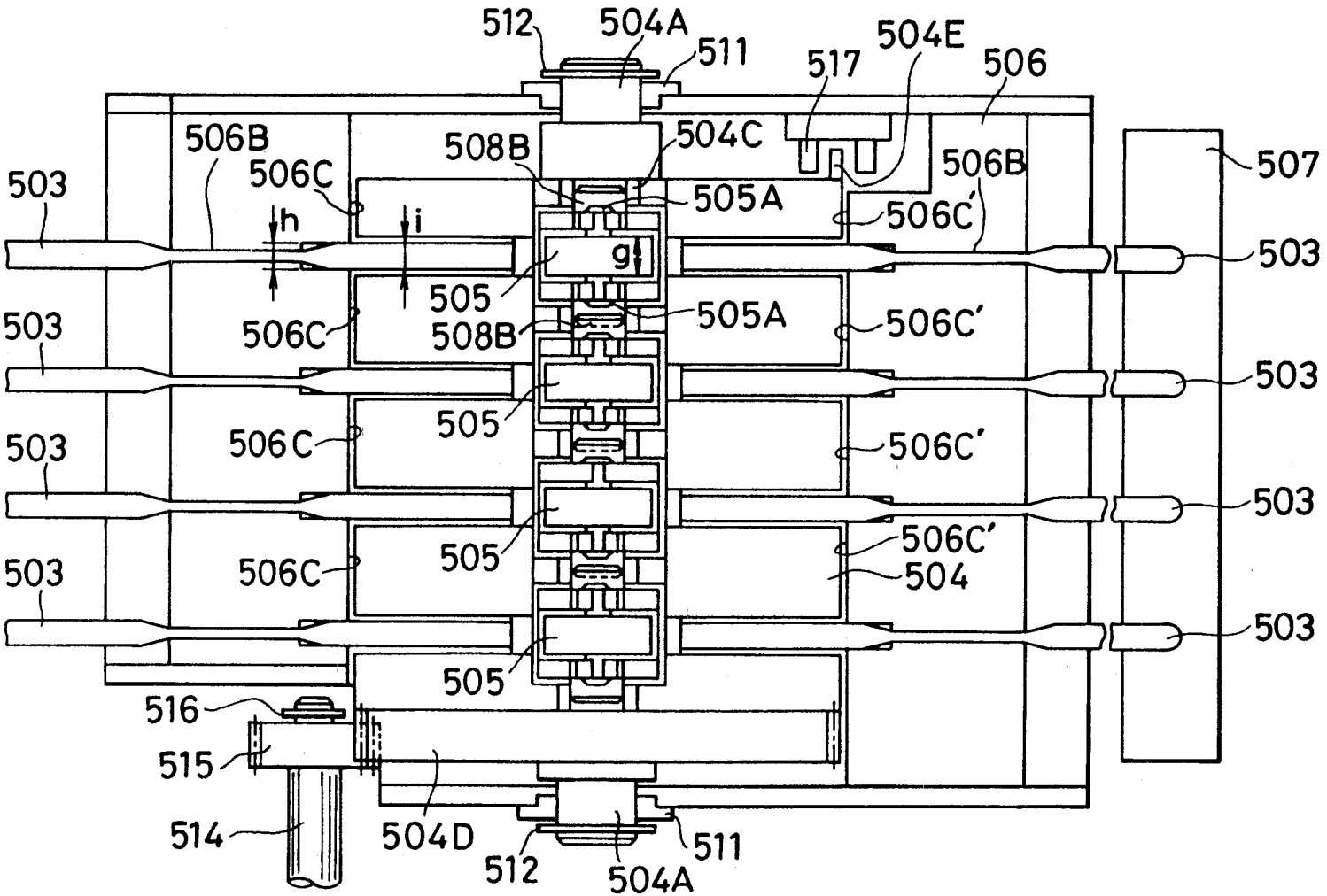
FIG. 4 is a plan view of the recovering unit of FIG. 3.

In this embodiment, shown in FIG. 4, the width of the tube grooves close to the roller guide portions 506C is enlarged. This is made so that any undesirable reaction force of each of the tubes 503 may not affect on the corresponding pressurizing roller 505 at a position where the guide roller 504 begins to contact the tube 503. More specifically, the width h of the groove adjacent to the roller guide portion 506C is made larger than the width i of the tube 503 when the tube 503 is pressed by the corresponding pressurizing roller 505, and thereby undesirable reaction force due to restriction of deformation of the tube 503 by the groove is prevented from being produced. The width h of the grooves must be smaller than the thickness g of the respective pressurizing rollers 505 since the grooves serve as guides of the rollers 505.

When the guide roller 504 further rotates in the direction of the arrow a, the pressurizing rollers 505 are rotated in the direction of the arrow b in a following fashion, squashing the corresponding tubes 503. The, the pressurizing rollers 505 are temporarily stopped at the position Y shown by the broken line in FIG. 3. Negative pressure is produced on the orifices defining the face 1A of each head due to changes in volume within the corresponding tube 503 squashed by the pressurizing roller 505 while the pressurizing roller 505 moves from the position X to the position Y, and thereby suction operation at orifices is performed.

Figure 1A:
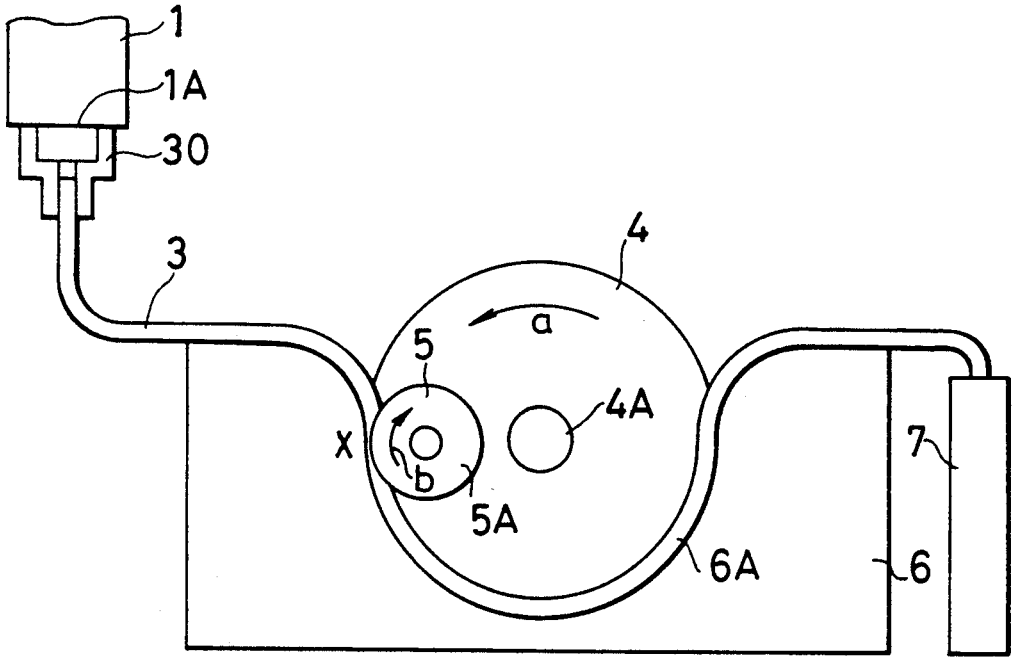
FIG. 1A (PRIOR ART)
FIGS. 1A and 1B are illustrations of the construction and operation of at tube pump of the prior art.
Figure 1B:
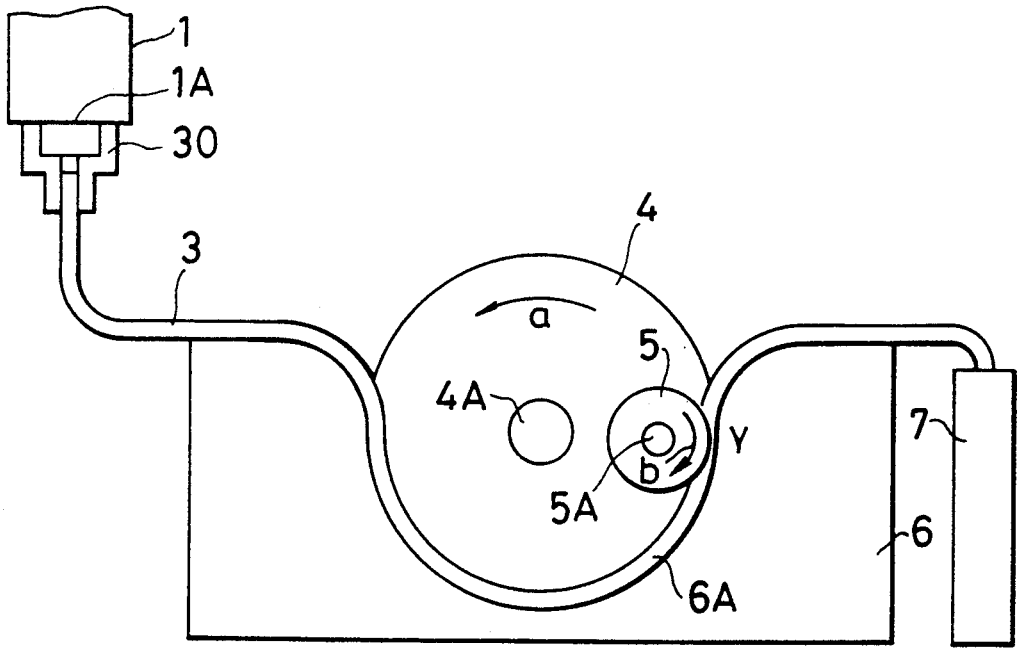
FIG. 1B (PRIOR ART)

Similarly to the unit of FIGS. 1A and 1B, a waste ink container 507 is arranged downstream of the corresponding tube 503 to contain ink sucked out from the corresponding orifices.

After the suction is completed, the guide roller 504 further rotates in the direction of the arrow a, and the pressurizing rollers 505 are thereby guided along respective roller guides 506C' which have the structure as the roller guides 506C, so that the pressurizing rollers 505 gradually move away from the corresponding tubes 503. The pressurizing rollers 505 perform operation opposite to the operation when the pressurizing rollers 505 come into contact with tubes 503. Also in this event, the change in torque is minimized when the tubes 503 are released from respective pressurizing rollers 505.

Figure 6:
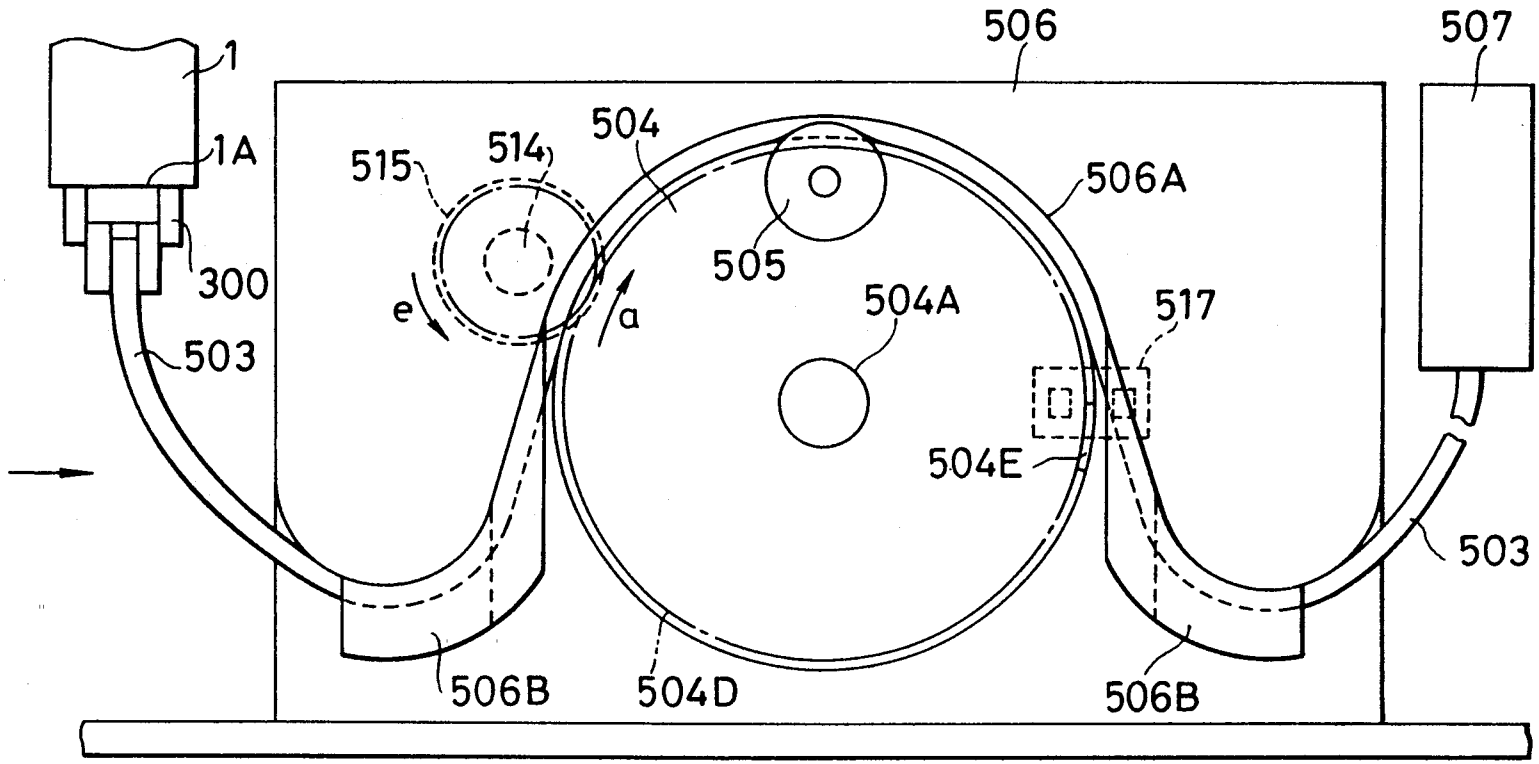
FIG. 6 is a front view in section illustrating the operation of the recovering unit of FIG. 3.

The series of operations previously described may be controlled as follows: a transmission type photosensor 157 is, as shown in FIG. 6, mounted on the pump base 506 so that projections 504E, provided on the roller 504, may pass over the photosensor 517; and the positioning of the pressurizing rollers 505 is achieved according to detection signals of the photosensor 517. Such a control may be conducted using a control system disclosed in Japanese patent application Laying-open No. 73354/1991.

Other Embodiments

In the preceding embodiment, the paper feed motor (sub scanning motor) is used as a drive motor of the pump, and the torque is transmitted through one of the paper feed rollers but the torque may be transmitted through other transmission mechanisms. A single motor may be used as both the carriage drive motor (main scanning motor) and the pump drive motor. These motors may be separately used.

According to the embodiment previously described, guides are integrally formed with groove defining members which define grooves to secure tubes, each guide being to guide the corresponding pressurizing roller to a position to press the tube. The guides may be separately formed, in which case each pair of guides for introducing and releasing the pressurizing roller may be integrally formed.

Figure 7:
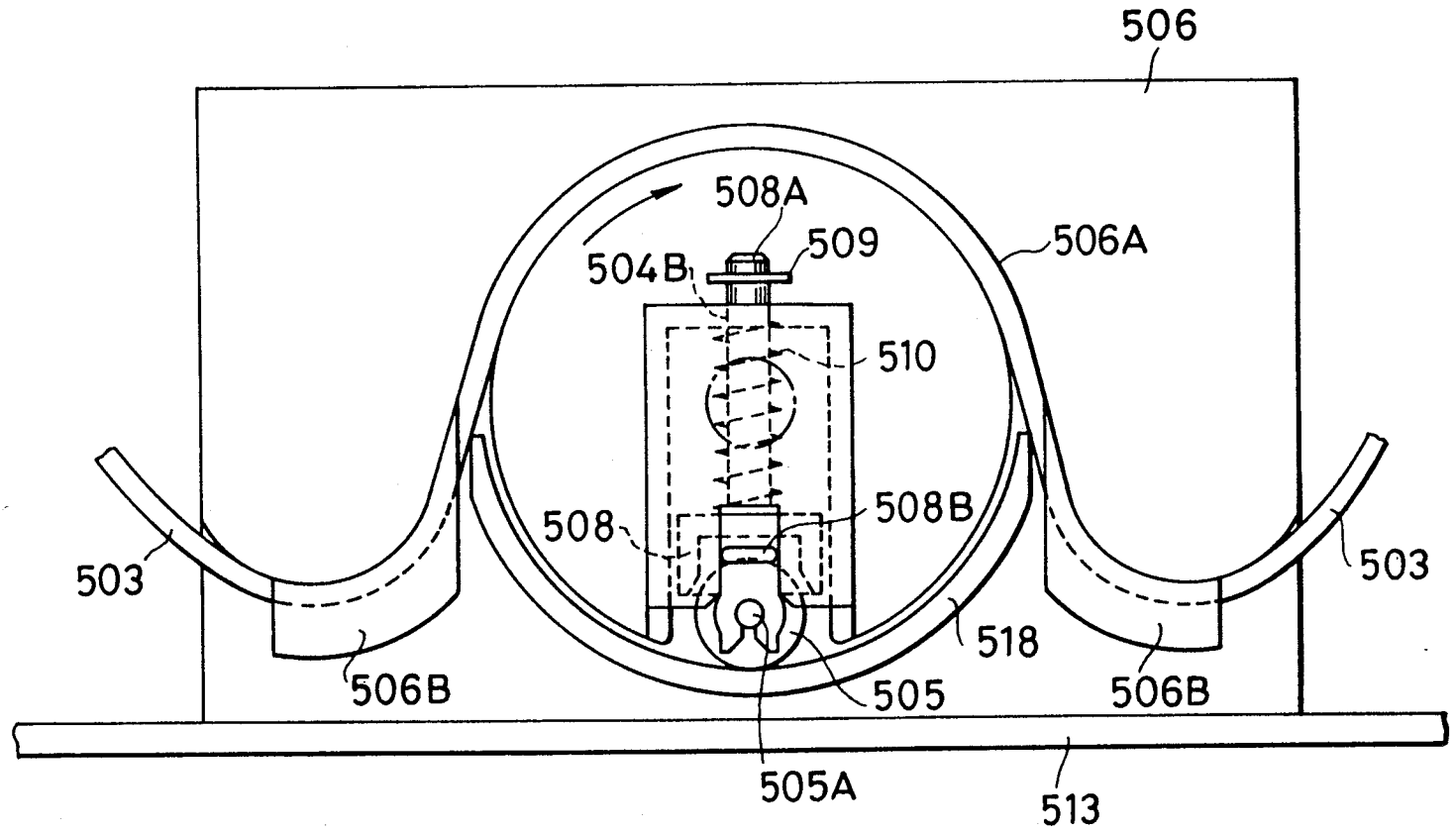
FIG. 7 is a front view in section of another embodiment of a recovering unit according to the present invention.

FIG. 7 illustrate such a modified form. The guide member 518 is formed as shown, and the corresponding pressurizing roller 505 is always displaced to a position corresponding to a position to press the tube 503 by the guide member 518 while the pressurizing roller 505 is not in contact with the tube 503. This modification achieves an advantage in that changes in torque due to movement of the pressurizing rollers 505 radially of the guide roller 504 are removed. The movement of the pressurizing rollers 505 radially of the guide roller 504 includes the movement of the pressurizing rollers 505 in the f direction by the respective roller guides 506C and due to releasing of the pressurizing rollers 505 from respective roller guides 506C. The other parts indicated by the same reference numerals as the parts of the first embodiment are corresponding parts, and therefore descriptions thereof are omitted.

In the first embodiment, the guide roller 504 is rotated in the direction of the arrow a for performing ejection recovering by suction. The present invention may be applied to another modified form of the recovering unit in which ink is forcedly discharged through orifices by pressurizing the ink supply system for achieving recovering. In this case, the recovering system is connected to the ink supply system, and the pressurizing rollers are reversely rotated (that is, the guide roller 504 is reversely rotated). Although in this modification, the introduction side and the releasing side of each pressurizing roller 505 are located oppositely to those in FIG. 3, and hence there is no difference in change in torque, and the same effect is produced.

In the first embodiment, the pressurizing rollers 505 are spring biased by the compression spring 510 against the tubes 503, but the same effect may be achieved by making the pressurizing rollers 505 of an elastic material.

Figure 8:
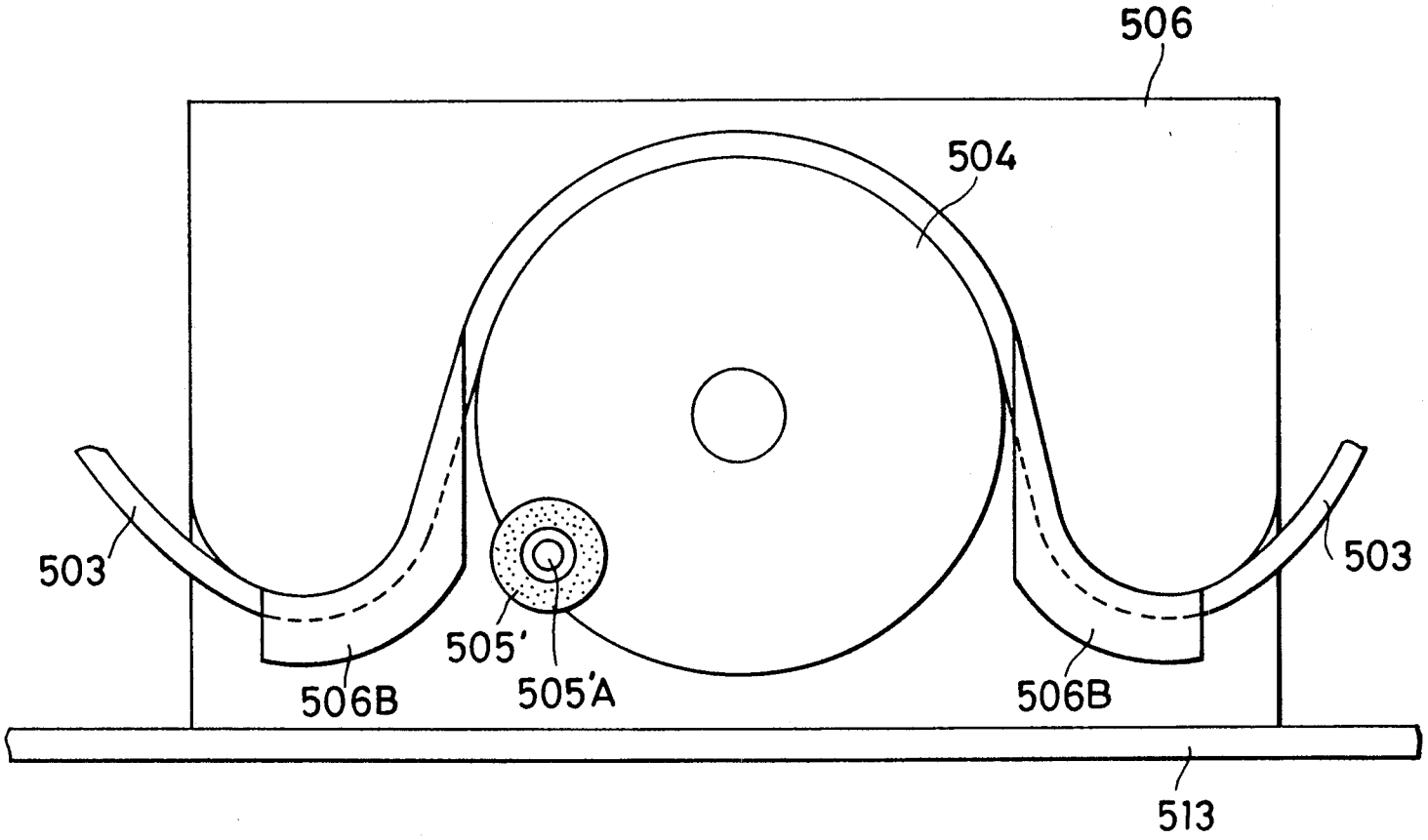
FIG. 8 is a front view in section of still another embodiment of a recovering unit according to the present invention.

FIG. 8 illustrates such a modified pressurizing roller 505'. The pressurizing roller 505' is rotatably mounted at a shaft 505'A thereof to a guide roller 504, and the portion thereof which performs pressurizing of the tube 503 is made of an elastic material such as a rubber. Parts corresponding to parts of FIG. 7 are designated by the same reference numerals, and descriptions thereof are hence omitted.

As described above, in a tube pump in which suction and pressurization is carried out, utilizing deformation of the tube, pressurizing member, such as a roller, for deforming the tube is, according to the present invention, resiliently biased in a direction to pressurize the tube. Thus, the amount of penetration of the pressurizing member into the tube is flexibly determined according to resilient biasing, not component accuracy. This enables that any increase in drive torque of the pump due to variation of component tolerances is prevented, and that reduction in size and cost of a pump drive motor is realized. This construction also enables that an increase in torque is suppressed as compared to the conventional construction in the case where the pump is assembled using tubes and pressurizing rollers with a plurality of heads.

Furthermore, according to the present invention, the guides means is provided for guiding the pressurizing member to a state corresponding to a tube pressurizing state before or behind a tube pressurizing region. This feature enables change in torque to be minimized, the change being produced at instant when the tube is pressed by or released from the pressurizing member, so that step-out of drive motor and dispersion in paper feed accuracy or in main scanning in the case where the pump drive motor is commonly used as the main or the sub scanning motor are effectively eliminated. Thus, the pump drive motor and the main or the such scanning motors may be constituted by a single motor, and reduction in scale and cost of the system is therefore realized.

Further Description

In the case that the present invention is applied to an ink jet printer, the present invention is particularly suitably useable in an ink jet recording head having heating elements that produce thermal energy as energy used for ink ejection or discharge and recording apparatus using the head. This is because, the high density of the picture element, and the high resolution of the recording are possible.

The typical structure and the operational principle are preferably the one disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on liquid (ink) retaining sheet or ink passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected from quick response. The driving signal in the form of the pulse is preferably such as disclosed in U.S. Pat. No. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Patent Application Laying-open No. 123670/1984 wherein a common slit is used as the ejection outlet for plurality electrothermal transducers, and to the structure disclosed in Japanese Patent Application Laying-open No. 138461/1984 wherein an opening for absorbing pressure wave of the thermal energy is formed corresponding to the ejecting portion. This is because, the present invention is effective to perform the recording operation with certainty and at high efficiency irrespective of the type of the recording head.

The present invention can be also applied to a so-called full-line type recording head whose length equals the maximum length across a recording medium. Such a recording head may consists of a plurality of recording heads combined together, or one integrally arranged recording head.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds and the number of the recording heads mounted, a single head corresponding to a single color ink may be equipped, or a plurality of heads corresponding respectively to a plurality of ink materials having different recording color or density may be equipped. The present invention is effectively applicable to an apparatus having at least one of a monochromatic mode solely with main color such as black and a multi-color mode with different color ink materials or a full-color mode by color mixture. The multi-color or full-color mode may be realized by a single recording head unit having a plurality of heads formed integrally or by a combination of a plurality of recording heads.

Furthermore, in the foregoing embodiment, the ink has been liquid. It may, however, be an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Patent Application Laying-open No. 56847/1979 and Japanese Patent Application Laying-open No. 71260/1985. The sheet is faced to the electrothermal transducers. The most effective one for the ink materials described above is the film boiling system.

The ink jet recording apparatus may be used as an output means of various types of information processing apparatus such as a work station, personal or host computer, a word processor, a copying apparatus combined with an image reader, a facsimile machine having functions for transmitting and receiving information, or an optical disc apparatus for recording and/or reproducing information into and/or from an optical disc. These apparatus requires means for outputting processed information in the form of hand copy.

Figure 9:
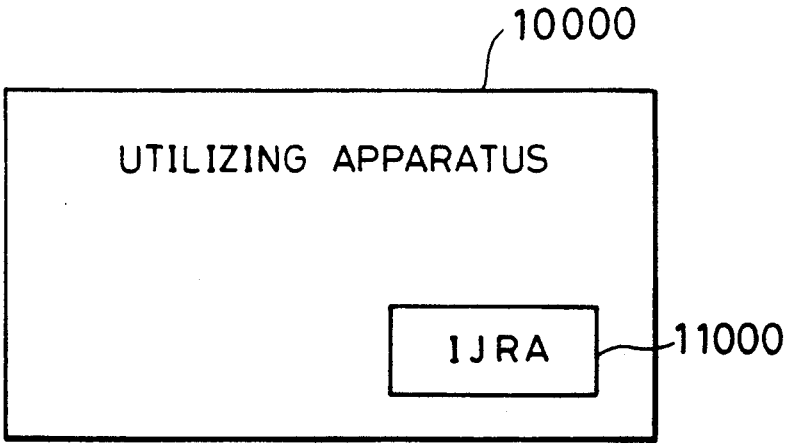
FIGS. 9 and 10 schematically illustrate two embodiments of a utilizing apparatus in accordance with the present invention.

FIG. 9 schematically illustrates one embodiment of a utilizing apparatus in accordance with the present invention to which the ink jet recording system shown in FIG. 2 is equipped as an output means for outputting processed information.

In FIG. 9, reference numeral 10000 schematically denotes a utilizing apparatus which can be a work station, a personal or host computer, a word processor, a copying machine, a facsimile machine or an optical disc apparatus. Reference numeral 11000 denotes the ink jet recording apparatus (IJRA) shown in FIG. 2. The ink jet recording apparatus (IJRA) 11000 receives processed information from the utilizing apparatus 10000 and provides a print output a hand copy under the control of the utilizing apparatus 10000.

Figure 10:
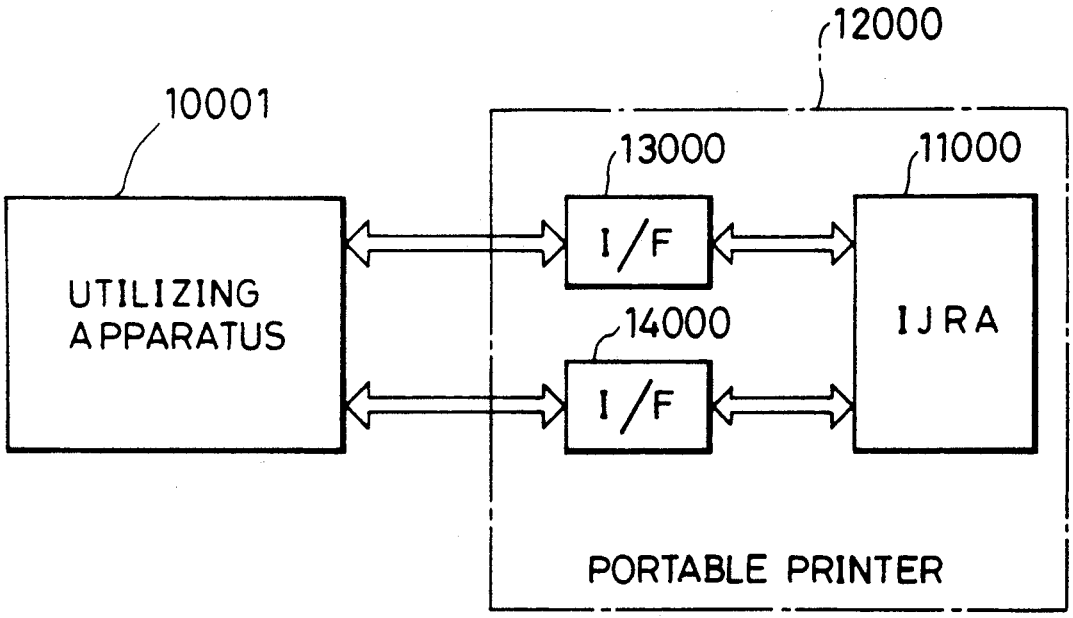

FIG. 10 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 10, reference numeral 10001 schematically denotes such a utilizing apparatus. Reference numeral 12000 schematically denotes a portable printer having the ink jet recording apparatus (IJRA) 11000 shown in FIG. 2 is incorporated thereinto and interface circuits 13000 and 14000 receiving information processed by the utilizing apparatus 11001 and various controlling data for controlling the ink jet recording apparatus 11000, including hand shake and interruption control from the utilizing apparatus 11001. Such control per se is realized by conventional printer control technology.

The present invention has been described in detail with respect to preferred embodiments, and it apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A recovering mechanism for an ink jet recording apparatus, for maintaining or recovering an ejection state or an ink jet head by discharging ink through at least one orifice of said ink jet head in an enforced manner, comprising:

a flexible tube having an axial direction;

a movable pressurizing member having a pressurizing state for producing pressure in said flexible tube in order to perform the enforced discharging of ink by resiliently deforming said tube continuously along said axial direction, said pressurizing member defining a region abutting said flexible tube, said pressure being produced as said pressurizing member moves into said region;

biasing means for resiliently biasing said pressurizing member to press against said tube;

guide means for guiding said pressurizing member, said guide means being disposed in a region outside of said region where said pressurizing member abuts said flexible tube in a manner such that said guide means acts to place said pressurizing member in a state which is substantially similar to said pressurizing state.

2. A recovering mechanism for an ink jet recording apparatus as claimed in claim 1, further comprising a base of said unit and a restraining member for restraining the tube to said base, and wherein said guide means and said restraining member are integrally formed.

3. A recovering mechanism for an ink jet recording apparatus as claimed in claim 2, wherein said guide means is disposed in a position selected from the group consisting of before, behind, or before and behind said region to press said tube.

4. A recovering mechanism for an ink jet recording apparatus as claimed in claim 1, wherein said pressurizing member has a roller, and said biasing means has a spring.

5. A recovering mechanism for an ink jet recording apparatus as claimed in claim 1, wherein said pressurizing member and said biasing means are integrally formed as one member which has a roller having a portion made of an elastic material, said portion performing pressurizing of said tube.

6. An ink jet recording apparatus comprising:

at least one ink jet head;

a recovering mechanism for maintaining or recovering an ejection state of said ink jet head by discharging an ink through at least one orifice of said ink jet head in an enforced manner, comprising:

a flexible tube having an axial direction;

a movable pressurizing member having a pressurizing state for producing pressure in said flexible tube in order to perform the enforced discharging of ink by resiliently deforming said tube continuously along said axial direction, said pressurizing member defining a region abutting said flexible tube, said pressure being produced as said pressurizing member moves into said region;

biasing means for resiliently biasing said pressurizing member to press against said tube;

guide means for guiding said pressurizing member, said guide means being disposed in a region outside of said region where said pressurizing member abuts said flexible tube in a manner such that said guide means acts to place said pressurizing member in a state which is substantially similar to said pressurizing state; and transporting means for transporting a recording medium to a recording position in which recording is carried out by said at least one ink jet head.

7. An ink jet recording apparatus as claimed in claim 6, further comprising drive means for driving said pressurizing member to deform said tube continuously in the pressurizing state, said drive means including a drive source, said drive source being also used as a drive source for said transporting means.

8. An ink jet recording apparatus as claimed in claim 6, further comprising scanning means for performing horizontal scanning of the ink jet head over said recording medium.

9. An ink jet recording apparatus as claimed in claim 8, further comprising drive means for driving said pressurizing member to deform said tube continuously in the pressurizing state, said drive means including a drive source, said drive source being also used as a drive source for said scanning means.

10. An ink jet recording apparatus as claimed in claim 6, wherein said at least one ink jet head has an element or elements for generating thermal energy to produce film boiling in ink, said thermal energy being to be used for ink ejection.

11. A liquid transporting apparatus comprising:

a hollow resilient member adapted to flow liquid therethrough;

a movable pressurizing member having a pressurizing state, said pressurizing member defining a region abutting said hollow resilient member;

a member to be pressed;

pressure producing means for placing said pressurizing member in said pressurizing state as said pressurizing member moves into a first region, in said pressurizing state said pressurizing member being urged against said member to be pressed with said hollow resilient member sandwiched therebetween so that said pressure is produced as said pressurizing member moves into said first region, and for moving the pressurizing member in said pressurizing state in a manner which creates a pressure to cause liquid to flow; and guide means for guiding said pressurizing member, said guide means being disposed in a second region outside said first region in a manner such that said guide means acts to place said pressurizing member in a state which is substantially similar to said pressurizing state.

* * * * *

UNITED STATES PATENT AND TRADEMARK OFFICE

CERTIFICATE OF CORRECTION

PATENT NO. : 5,309,180

DATED : May 3, 1994

INVENTOR(S) : HARUO UCHIDA

It is certified that error appears in the above-identified patent and that said Letters Patent is hereby corrected as shown below:

COLUMN 1

Line 31, "a" (first occurrence) should read --an--.
Line 62, "constitute" should read --constituting--.

COLUMN 2

Line 5, "plays to" should read --play of--.
Line 6, "bring" should read --brings--.
Line 15, "like" should read --likely--.

COLUMN 3

Line 11, "of" should read --to--.
Line 52, "to be" should be deleted.
Line 55, "comprise:" should read --comprises:--.

COLUMN 4

Line 3, "urged" should read --urge--.
Line 14, "at" should read --a--.
Line 18, "a" (second occurrence) should read --an--.

COLUMN 5

Line 58, "removed" should read --moved--.

COLUMN 7

Line 1, "e" should read --be--.
Line 20, "roller 505" should read --rollers 505--.
Line 34, "pressed" should read --presses--.

--

UNITED STATES PATENT AND TRADEMARK OFFICE

CERTIFICATE OF CORRECTION

PATENT NO. : 5,309,180

DATED : May 3, 1994

INVENTOR(S) : HARUO UCHIDA

It is certified that error appears in the above-identified patent and that said Letters Patent is hereby corrected as shown below:

COLUMN 7

Line 35, "504" should read --503-- and
"portion 504C," should read --506C,--.
Line 58, "The," should read --Then,--.

COLUMN 8

Line 6, "structure" should read --same structure--.
Line 16, "157" should read --517--.
Line 41, "illustrate" should read --illustrates--.

COLUMN 9

Line 38, "instant" should read --the instant--.
Line 44, "such" should read --sub--.

COLUMN 10

Line 9, "from" should read --with--.
Line 23, "plurality" should read --plural--.
Line 34, "consists" should read --consist--.

COLUMN 11

Line 38, "requires" should read --require--.
Line 53, "a hand" should read --as a hard--.
Line 65, "is" should be deleted.

--

UNITED STATES PATENT AND TRADEMARK OFFICE

CERTIFICATE OF CORRECTION

PATENT NO. : 5,309,180

DATED : May 3, 1994

INVENTOR(S) : HARUO UCHIDA

It is certified that error appears in the above-identified patent and that said Letters Patent is hereby corrected as shown below:

COLUMN 12

Line 5, "apparent" should read --is apparent--.
Line 15, "or" should read --of--.
Line 28, "tube;" should read --tube; and--.

COLUMN 14

Line 14, "to be" should be deleted.

Signed and Sealed this

Third Day of January, 1995

Bruce Lehman

*Attest:*

BRUCE LEHMAN

*Attesting Officer*

*Commissioner of Patents and Trademarks*

--